US010203066B2

(12) United States Patent
Ducloy et al.

(10) Patent No.: US 10,203,066 B2
(45) Date of Patent: Feb. 12, 2019

(54) TANK EQUIPPED WITH A WALL HAVING A SPECIFIC ZONE THROUGH WHICH PASSES A THROUGH-ELEMENT

(71) Applicant: GAZTRANSPORT ET TECHNIGAZ, Saint Remy les Chevreuse (FR)

(72) Inventors: Edouard Ducloy, Boulogne-Billancourt (FR); Hilarion Givoloup, Cergy (FR)

(73) Assignee: GAZTRANSPORT ET TECHNIGAZ, Saint Remy les Chevreuse (FR)

( * ) Notice: Subject to any disclaimer, the term of this patent is extended or adjusted under 35 U.S.C. 154(b) by 0 days.

(21) Appl. No.: 15/565,819

(22) PCT Filed: Apr. 14, 2016

(86) PCT No.: PCT/FR2016/050866
§ 371 (c)(1),
(2) Date: Oct. 11, 2017

(87) PCT Pub. No.: WO2016/166481
PCT Pub. Date: Oct. 20, 2016

(65) Prior Publication Data

US 2018/0112823 A1 Apr. 26, 2018

(30) Foreign Application Priority Data

Apr. 15, 2015 (FR) ..... 15 53349

(51) Int. Cl.
*F17C 3/04* (2006.01)
*F17C 3/02* (2006.01)
(Continued)

(52) U.S. Cl.
CPC ..... *F17C 3/027* (2013.01); *B63B 25/16* (2013.01); *B63B 27/24* (2013.01); *F17C 3/04* (2013.01);
(Continued)

(58) Field of Classification Search
CPC ..... B63B 25/16; F17C 2221/033; F17C 2221/035; F17C 2221/036; F17C 13/004
See application file for complete search history.

(56) References Cited

U.S. PATENT DOCUMENTS 9,335,003 B2 * 5/2016 Shin ..... B63B 25/16
9,518,700 B2 * 12/2016 Herry ..... F17C 3/027
(Continued)

FOREIGN PATENT DOCUMENTS

FR 2996520 A1 4/2014
JP H058194 U 2/1993
(Continued)

OTHER PUBLICATIONS

International Search Report for corresponding PCT application No. PCT/FR2016/050866, dated Oct. 21, 2016.

*Primary Examiner* — Andrew Polay
(74) *Attorney, Agent, or Firm* — Notaro, Michalos & Zaccaria P.C.

(57) ABSTRACT

A sealed and thermally insulating tank intended for the storage of a fluid, the tank having a secondary insulating barrier having juxtaposed insulating panels; and a primary insulating barrier having insulating panels that are each arranged straddling at least four secondary insulating panels and anchored to the latter. The sealed tank is equipped with a through-element passing through a specific zone of the wall. In the specific zone of the wall, the longitudinal directions of the primary panels are perpendicular to the longitudinal directions of the secondary insulating panels. The through-element passes successively through an opening made in one of the secondary insulating panels and an opening made in one of the primary insulating panels.

25 Claims, 10 Drawing Sheets

(51) Int. Cl.

| | |
|---|---|
| ***B63B 25/16*** | (2006.01) |
| ***B63B 27/24*** | (2006.01) |
| ***F17C 6/00*** | (2006.01) |

(52) U.S. Cl.

CPC ..... *F17C 6/00* (2013.01); *F17C 2201/0157* (2013.01); *F17C 2201/052* (2013.01); *F17C 2203/035* (2013.01); *F17C 2203/0333* (2013.01); *F17C 2203/0358* (2013.01); *F17C 2203/0379* (2013.01); *F17C 2203/0631* (2013.01); *F17C 2203/0643* (2013.01); *F17C 2203/0646* (2013.01); *F17C 2203/0651* (2013.01); *F17C 2205/0352* (2013.01); *F17C 2205/0355* (2013.01); *F17C 2209/23* (2013.01); *F17C 2221/033* (2013.01); *F17C 2223/0161* (2013.01); *F17C 2223/033* (2013.01); *F17C 2227/0135* (2013.01); *F17C 2250/043* (2013.01); *F17C 2250/0491* (2013.01); *F17C 2260/011* (2013.01); *F17C 2260/033* (2013.01); *F17C 2260/037* (2013.01); *F17C 2265/031* (2013.01); *F17C 2265/034* (2013.01); *F17C 2270/0107* (2013.01)

(56) References Cited

U.S. PATENT DOCUMENTS

| | | | | |
|---|---|---|---|---|
| 10,072,798 | B2 * | 9/2018 | Herry | F17C 3/027 |
| 2017/0175952 | A1 * | 6/2017 | Heo | B63B 25/16 |

FOREIGN PATENT DOCUMENTS

| | | | |
|---|---|---|---|
| JP | 2001108198 | A | 4/2001 |
| WO | 2011157915 | A1 | 12/2011 |
| WO | 2013004943 | A1 | 1/2013 |
| WO | 2013004944 | A1 | 1/2013 |
| WO | 2014128381 | A1 | 8/2014 |

* cited by examiner

TANK EQUIPPED WITH A WALL HAVING A SPECIFIC ZONE THROUGH WHICH PASSES A THROUGH-ELEMENT

TECHNICAL FIELD

The invention relates to the field of membrane-type sealed and thermally insulating tanks for storing and/or transporting fluid, such as a cryogenic fluid.

Membrane-type sealed and thermally insulating tanks are, in particular, used for storing liquefied natural gas (LNG), which is stored, at atmospheric pressure, at approximately −162° C.

PRIOR ART

Document FR2996520 discloses a sealed and thermally insulating tank for storing liquefied natural gas having a multi-layer structure retained on a carrying structure. Each wall has in succession, in the direction of the thickness, from the exterior toward the interior of the tank, a secondary thermally insulating barrier retained on the carrying structure, a secondary sealing membrane resting against the secondary thermally insulating barrier, a primary thermally insulating barrier resting against the secondary sealing membrane, and a primary sealing membrane carried by the primary thermally insulating barrier and intended to be in contact with the liquefied natural gas contained in the tank.

The primary and secondary thermally insulating barriers comprise, respectively, a plurality of primary and secondary insulating panels of rectangular parallelepipedal form that are juxtaposed in parallel rows. The longitudinal directions of the primary insulating panels are parallel to those of the secondary insulating panels. Each primary insulating panel is arranged straddling four secondary insulating panels. Furthermore, each primary insulating panel is anchored at each of its four corners on an anchoring member fixed to the center of the internal face of one of the secondary insulating panels it straddles. The primary and secondary sealing membranes are each constituted by a plurality of metal sheets comprising corrugations and enabling them to be deformed through the effect of the thermal and mechanical stresses generated by the fluid stored in the tank. The metal sheets of the secondary sealing membrane are anchored on the secondary insulating panels and the metal sheets of the primary sealing membrane are anchored on the primary insulating panels.

The sealed and thermally insulating tanks for storing liquefied natural gas are equipped with sealed conduits each passing through a specific zone of one of the walls in order to define a passage between the interior space of the tank and the exterior of the tank. This is, in particular, the case at the top wall, which is traversed by a sealed conduit emerging in the upper part of the internal space of the tank and thus defining a vapor passage between the interior space of the tank and a vapor collector arranged outside the tank. A sealed conduit of this type thus makes it possible to avoid the generation, inside the tank, of an excess pressure liable to be produced by the natural evaporation of the liquefied natural gas stored inside the tank.

Although a sealed conduit of this type generally has a diameter that is smaller than the width of the primary and secondary insulation panels, as described in the aforesaid document FR2996520, this diameter is, however, likely to be sufficiently large for said sealed conduit to be unable, given the arrangement of the primary insulating panels straddling the secondary insulating panels, to traverse a primary insulating panel and a secondary insulating panel without at least one cut-out being made in an edge of one or more primary or secondary insulating panels. In point of fact, the formation of a cut-out in an edge of an insulating panel is undesirable because it reduces the rigidity of said insulating panel and weakens its mechanical strength.

Moreover, a cut-out made in an edge of an insulating panel is also likely to lead to greater stress in certain zones of the metal sheets bordering the sealed conduit, in the specific zone of the tank wall.

Similar problems are also likely to arise in the bottom wall of the tank, for example at a draining structure or at any other element passing through a specific zone of the tank wall.

SUMMARY

One idea underpinning the invention is to propose a multi-layer-structure tank equipped with a through-element passing through a specific zone of a wall of the tank and having primary insulating panels anchored straddling a plurality of secondary panels and in which the structure of the tank in said specific zone is simple and has only a minor impact on the thermomechanical stress resistance of the tank.

According to one embodiment, the invention provides a sealed and thermally insulating tank intended for the storage of a fluid, said tank comprising a tank wall fixed to a carrying structure, the wall comprising successively, in the direction of the thickness, from the exterior to the interior of the tank, a secondary thermally insulating barrier retained against the carrying structure, a secondary sealing membrane carried by the secondary thermally insulating barrier, a primary thermally insulating barrier resting against the secondary sealing membrane, and a primary sealing membrane carried by the primary thermally insulating barrier and designed to be in contact with the fluid contained in the tank;

- the secondary thermally insulating barrier comprising juxtaposed secondary insulating panels, retained against the carrying structure and having a rectangular parallelepipedal form having a longitudinal direction, each secondary insulating panel having an internal face, opposite the carrying wall, equipped with at least one anchoring member;
- the primary thermally insulating barrier comprising juxtaposed primary insulating panels, having a rectangular parallelepipedal form having a longitudinal direction, each primary insulating panel being arranged straddling at least four secondary insulating panels and anchored to said anchoring member of each of the secondary insulating panels that said primary insulating panel straddles;
- the sealed tank being equipped with a through-element passing through a specific zone of the wall;
- the primary thermally insulating barrier comprising, in the specific zone of the tank wall, a primary series of primary insulating panels having mutually parallel longitudinal directions;
- the secondary thermally insulating barrier comprising, in the specific zone of the wall, a secondary series of secondary insulating panels having mutually parallel longitudinal directions;
- the primary series and the secondary series being arranged one relative to the other such that the longitudinal directions of the primary insulating panels of the primary series are perpendicular to the longitudinal directions of the secondary insulating panels of the secondary series;

the through-element extending in the direction of the thickness of the specific zone of the wall and passing successively through an opening made in one of the secondary insulating panels of the secondary series, through an opening made in the secondary sealing membrane, through an opening made in one of the primary insulating panels of the first series, and through an opening made in the primary sealing membrane.

Thus, by virtue of the orientation of the primary insulating panels of the primary series perpendicularly to the orientation of the secondary insulating panels of the secondary series, the through-element passes through continuous-periphery openings of one of the primary insulating panels and of one of the secondary insulating panels without a cut-out being formed in an edge of said insulating panels, since each of the primary insulating panels is offset relative to the secondary insulating panels and straddling a plurality of them. In other words, the opening traversed by the through-element is separate from the edges of the primary or secondary panel, respectively.

The provision of an arrangement of this type in the specific zone of the tank wall is particularly simple and makes it possible to achieve good thermomechanical-stress-resistance properties in the specific zone.

According to other advantageous embodiments, a sealed and thermally insulating tank of this type may have one or more of the following features:

The secondary insulating panels, arranged in a remaining zone located around the specific zone of the wall, are arranged in parallel rows and have longitudinal directions oriented parallel to one another.

The primary insulating panels, arranged in said remaining zone, are arranged in parallel rows and have longitudinal directions oriented parallel to one another.

The longitudinal directions of the secondary insulating panels of the remaining zone are parallel to the longitudinal directions of the primary insulating panels of the remaining zone. Thus, the longitudinal directions of the insulating panels of one of the primary and secondary series are oriented perpendicularly to the longitudinal directions of the primary and secondary insulating panels of the remaining zone, and the longitudinal directions of the insulating panels of the other of the primary and secondary series are oriented parallel to the longitudinal directions of the primary and secondary insulating panels of the remaining zone.

The series of which the insulating panels have longitudinal directions oriented perpendicularly to the longitudinal directions of the primary and secondary insulating panels of the remaining zone is the primary series.

The primary insulating panels each have a longitudinal dimension equal to n times their transverse dimension, n being an integer greater than 1, and the first series comprises n primary insulating panels.

The primary insulating panels of the remaining zone have longitudinal and transverse dimensions identical to those of the primary insulating panels of the primary series.

The secondary series of secondary insulating panels comprises a row of secondary insulating panels extending from one edge to the other of the tank wall in a transverse direction perpendicular to the longitudinal direction of said secondary insulating panels, and the secondary insulating panels of the secondary series have a longitudinal dimension smaller than the longitudinal dimension of the secondary insulating panels in the remaining zone.

The longitudinal dimension of the secondary insulating panels of the secondary series is a whole multiple of the inter-corrugation distance between two successive corrugations of the secondary sealing membrane.

The opening through which passes the through-element that is made in the secondary insulating panel of the secondary series is arranged in the center of said secondary insulating panel.

The opening through which passes the through-element that is made in the primary insulating panel of the primary series is centered in the middle of the transverse dimension of said primary insulating panel.

The through-element has a cross section smaller than the transverse dimension of the primary and secondary insulating panels it traverses.

Each secondary insulating panel is associated with the adjacent secondary insulating panels by means of a plurality of bridging elements, each bridging element being arranged straddling between at least said secondary insulating panel and one said adjacent secondary insulating panel and being fixed, on the one hand, to an edge of the internal face of one of the secondary insulating panels and, on the other, to a facing edge of the internal face of the other secondary insulating panel so as to oppose a mutual distancing of said adjacent secondary insulating panels.

The bridging elements are bridging sheets that each have an external face resting against the internal face of each of the adjacent secondary insulating panels and an internal face carrying the secondary sealing membrane.

The internal face of each secondary insulating panel is equipped with metal plates, the secondary sealing membrane comprising, in the specific zone of the wall, a secondary closure sheet equipped with the opening of the secondary sealing membrane through which passes the through-element; said secondary closure sheet being welded on the metal plates of the secondary insulating panel equipped with the opening.

The secondary closure plate is welded on the through-element.

The secondary sealing membrane comprises a plurality of corrugated secondary metal sheets welded to one another in a sealed manner and each comprising at least two perpendicular corrugations, said secondary metal sheets being welded on the metal plates of the secondary insulating panels, the corrugated secondary metal sheets adjacent the secondary closure sheet being welded on the latter.

The through-element is centered on a position corresponding to the intersection between the mutually perpendicular directrices of two corrugations of the secondary metal sheets.

The two corrugations perpendicular to one another and the intersection of the directrices of which corresponds to the center of the through-element are closed in a sealed manner at the secondary closure sheet with end pieces each comprising a sole plate welded in a sealed manner to the secondary closure sheet and a shell welded in a sealed manner to said corrugation.

The secondary closure sheet comprises two pairs of parallel corrugations, the two corrugations of one and the same pair passing on either side of the opening and each extending in the extension of a corrugation of one of the secondary corrugated metal sheets.

According to one embodiment, the corrugations of the secondary metal sheets project toward the exterior of the tank in the direction of the carrying structure, the internal face of the secondary insulating panels having perpendicular grooves receiving the corrugations of the secondary metal sheets.

According to another embodiment, the corrugations of the secondary metal sheets project toward the interior of the tank, the primary insulating panels each having an external face having perpendicular grooves receiving the corrugations of the corrugated metal sheets of the secondary sealing membrane.

The primary sealing membrane comprises, in the specific zone of the wall, a primary closure sheet equipped with the opening of the primary sealing membrane through which passes the through-element; said primary sealing sheet being welded in a sealed manner to the through-element and being fixed on the primary insulating panel equipped with the opening.

Each primary insulating panel of the primary thermally insulating barrier has an internal face, opposite the carrying wall; said internal face being equipped with metal plates, the primary sealing membrane comprising a plurality of corrugated primary metal sheets welded to one another in a sealed manner and each comprising at least two perpendicular corrugations, said primary metal sheets being welded on the metal plates of the primary insulating panels, the corrugated primary metal sheets adjacent the primary closure sheet being welded to the latter.

The through-element is centered on a position corresponding to the intersection between a first and a second straight line, the first straight line being parallel to a first pair of parallel corrugations of the primary sealing membrane and arranged equidistantly between the corrugations of the first pair and the second straight line being parallel to a second pair of parallel corrugations that are perpendicular to the corrugations of the first pair and arranged equidistantly between the corrugations of the second pair.

The corrugations interrupted by the primary closure sheet are closed in a sealed manner at the primary closure sheet with end pieces each comprising a sole plate welded in a sealed manner to the primary closure sheet and a shell welded in a sealed manner to said corrugation.

The through-element is a sealed conduit passing through a specific zone of the wall in order to define a passage between the interior space of the tank and the exterior of the tank.

The through-element is a draining structure.

The draining structure comprises:

- a primary bowl connected to the primary sealing membrane,
- a secondary bowl, concentric with the primary bowl and connected to the secondary sealing membrane,
- primary insulating materials housed between the primary and secondary bowls,
- secondary insulating materials interposed between the secondary bowl and the carrying structure.

A tank of this type may form part of an onshore storage installation, for example for storing LNG, or be installed in a floating, coastal or deep-water structure, in particular a methane carrier, an ethane carrier, a floating storage regasification unit (FSRU), a floating production storage and offloading unit (FPSO), and the like.

According to one embodiment, a ship for transporting a fluid comprises a double hull and an aforesaid tank arranged in the double hull.

According to one embodiment, the invention also provides a method for loading or unloading a ship of this type, wherein a fluid is conveyed through insulated pipes from or toward a floating or onshore storage installation toward or from the ship's tank.

According to one embodiment, the invention also provides a system for transferring a fluid, the system comprising the aforesaid ship, insulated pipes arranged in such a manner as to connect the tank installed in the hull of the ship to a floating or onshore storage installation and a pump for entraining a fluid through the insulated pipes from or toward the floating or onshore storage installation toward or from the ship's tank.

BRIEF DESCRIPTION OF THE FIGURES

The invention will be better understood and further objects, details, features and advantages thereof will become more clearly apparent in the course of the following description of a plurality of particular embodiments of the invention, which are given solely by way of illustration and are non-limiting, with reference to the appended drawings.

DETAILED DESCRIPTION OF EMBODIMENTS

By convention, the terms "external" and "internal" are used to define the relative position of one element in relation to another, by reference to the interior and to the exterior of the tank. Furthermore, "longitudinal direction of a rectangular parallelepipedal element" is understood to mean the direction corresponding to that side of the rectangle that has the larger dimension.

Figure 1:
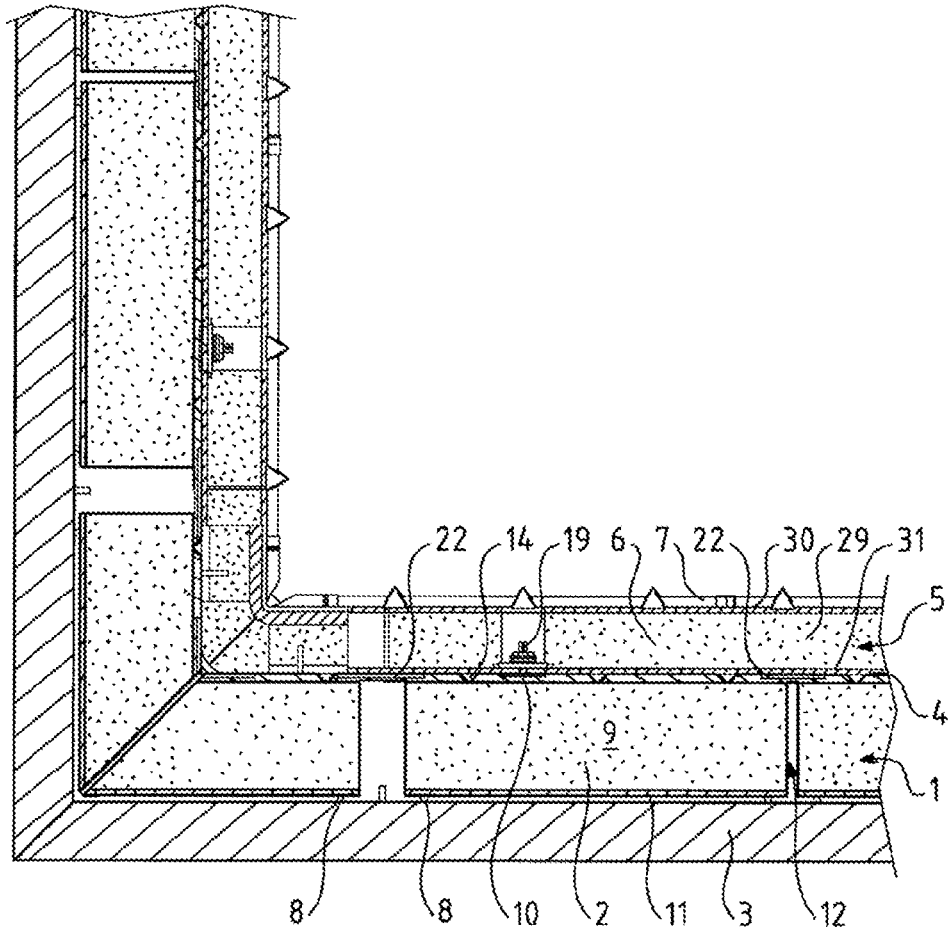
FIG. 1 is a sectional view of a sealed and thermally insulating tank for storing liquefied natural gas at a corner zone between two walls.
Figure 2:
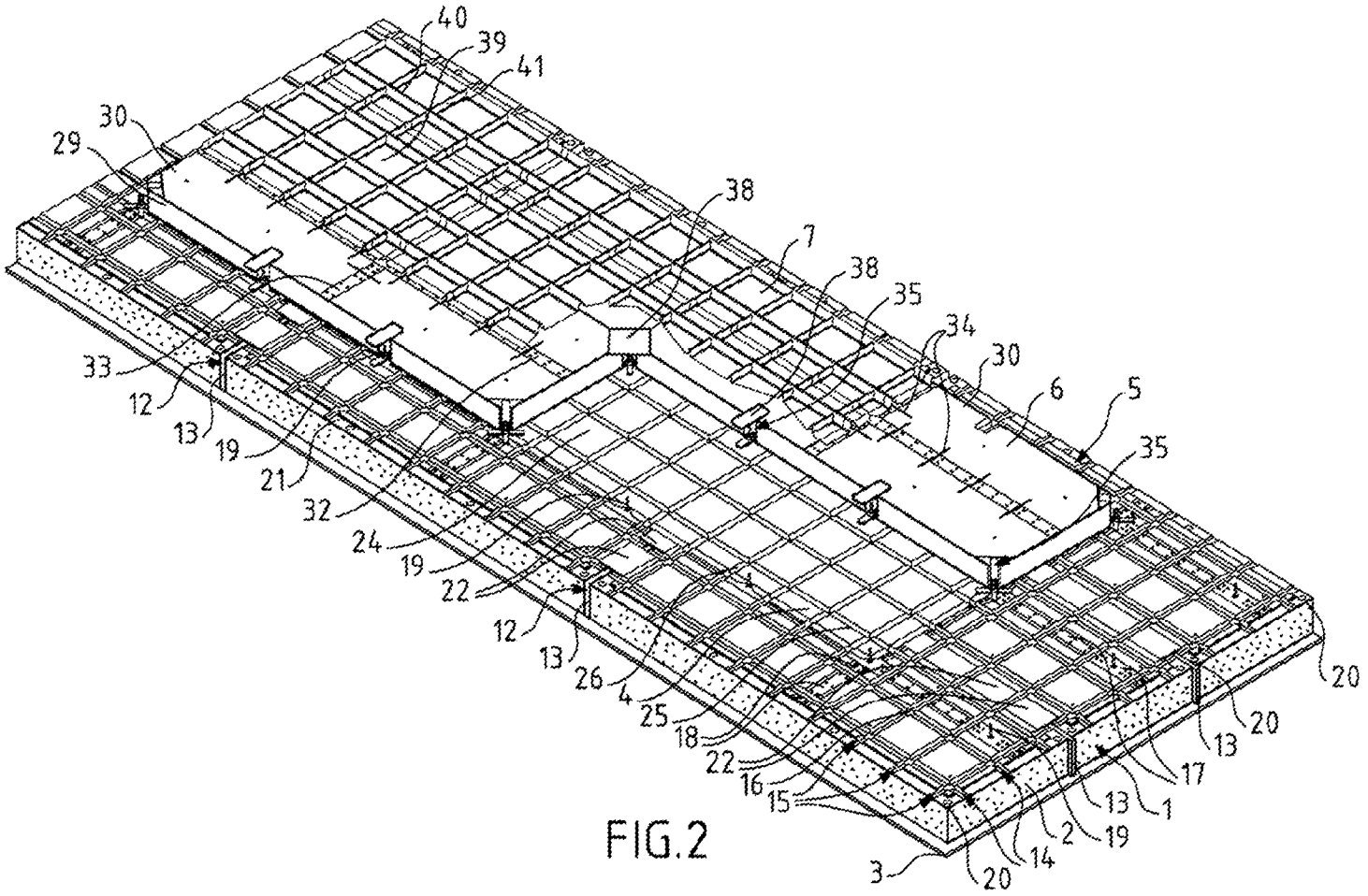
FIG. 2 is a perspective view, peeled-away, of a wall of the tank in a standard zone.

In connection with FIGS. 1 and 2, a description is given of the multi-layer structure of a sealed and thermally insulating tank for storing liquefied natural gas. Each wall of the tank comprises, from the exterior toward the interior of the tank, a secondary thermally insulating barrier 1 comprising juxtaposed insulating panels 2 anchored to a carrying structure 3 by secondary retention members 8, a secondary sealing membrane 4 carried by the insulating panels 2 of the secondary thermally insulating barrier 1, a primary thermally insulating barrier 5 comprising juxtaposed insulating panels 6 anchored on the insulating panels 2 of the secondary thermally insulating barrier 1 by primary retention members 19, and a primary sealing membrane 7, carried by the insulating panels 6 of the primary thermally insulating barrier 5 and intended to be in contact with the liquefied natural gas contained in the tank.

The carrying structure 3 may, in particular, be a self-supporting metal sheet or, more generally, any type of rigid partition having appropriate mechanical properties. The carrying structure 3 may, in particular, be formed by the hull or the double hull of a ship. The carrying structure 3 comprise a plurality of walls defining the general form of the tank, customarily a polyhedral form.

The secondary thermally insulating barrier 1 comprises a plurality of insulating panels 2 anchored on the carrying structure 3 by means of non-shown resin cords and/or pins 8 welded on the carrying structure 3. The insulating panels 2 have substantially a rectangular parallelepipedal form.

As illustrated in FIG. 1, the insulating panels 2 each comprise a layer 9 of insulating polymer foam sandwiched between an internal rigid sheet 10 and an external rigid sheet 11. The internal 10 and external 11 rigid sheets are, for example, plywood sheets glued to said layer 9 of insulating polymer foam. The insulating polymer foam may, in particular, be a polyurethane-based foam. The polymer foam is advantageously reinforced with glass fibers that contribute to reducing its coefficient of thermal contraction.

In a standard zone of a wall, such as shown in FIG. 2, the insulating panels are juxtaposed in parallel rows and separated from one another by gaps 12 guaranteeing a functional assembly clearance. The gaps 12 are filled with a non-conducting gasket 13, represented in FIG. 2, such as glass wool, rock wool or open-cell flexible synthetic foam, for example. The non-conducting gasket 13 is advantageously made from a porous material so as to provide gas-flow spaces in the gaps 12 between the insulating panels 2. The gaps 12 have, for example, a width of the order of 30 mm.

As shown in FIG. 2, the internal sheet 10 has two series of grooves 14, 15, which are perpendicular to one another, so as to form a network of grooves. Each of the series of grooves 14, 15 is parallel to two opposite sides of the insulating panels 2. The grooves 14, 15 are intended to receive corrugations, projecting toward the exterior of the tank, formed on the metal sheets of the secondary sealing membrane 4. In FIG. 2, each internal sheet 10 comprises three grooves 14 extending in the longitudinal direction of the insulating panel 2 and nine grooves 15 extending in the transverse direction of the insulating panel 2.

The grooves 14, 15 pass right through the thickness of the internal sheet 10 and thus emerge at the layer 9 of insulating polymer foam. Furthermore, the insulating panels 2 comprise, in the zones of intersection between the grooves 14, 15, clear orifices 16 made in the layer 9 of insulating polymer foam. The clear orifices 16 allow the accommodation of node zones formed at the intersections between the corrugations of the metal sheets of the secondary sealing membrane 4.

Moreover, the internal sheet 10 is equipped with metal plates 17, 18 for anchoring the edge of the corrugated metal sheets of the secondary sealing membrane 4 on the insulating panels 2. The metal plates 17, 18 extend in two perpendicular directions that are each parallel to two opposite sides of the insulating panels 2. The metal plates 17, 18 are fixed on the internal sheet 10 of the insulating panel 2 by screws, rivets or staples, for example. The metal plates 17, 18 are placed in recesses made in the internal sheet 10 such that the internal surface of the metal plates 17, 18 is flush with the internal surface of the internal sheet 10.

The internal sheet 10 is also equipped with threaded pins 19 projecting toward the interior of the tank and intended to fix the primary thermally insulating barrier 5 on the insulating panels 2 of the secondary thermally insulating barrier 1.

In order to fasten the insulating panels 2 to the pins 8 fixed to the carrying structure 3, the insulating panels 2 are provided with cylindrical wells 20, shown in FIG. 2, traversing the insulating panels 2 over their entire thickness and provided at each of the four corners of the insulating panels 2. The cylindrical wells 20 have a non-illustrated change in section, defining bearing surfaces for nuts interacting with the threaded ends of the pins 8.

Furthermore, the internal sheet 10 has, along its edges, in each interval between two successive grooves 14, 15, a cutout receiving the bridging sheets 22 that are each arranged straddling between two adjacent insulating panels 2, astride the gap 12 between the insulating panels 2. Each bridging sheet 22 is fastened against each of the two adjacent insulating panels 2 in such a manner as to oppose their mutual separation. The bridging sheets 22 have a rectangular parallelepipedal form and are, for example, formed from a plywood sheet. The external face of the bridging sheets 22 is fastened against the bottom of the cutouts 21. The depth of the cutouts 21 is substantially equal to the thickness of the bridging sheets 22 such that the internal face of the bridging sheets 22 reaches substantially to the other planar zones of the internal sheet 10 of the insulating panel. Thus, the bridging sheets 22 are capable of ensuring continuity in the bearing capacity of the secondary sealing membrane 4.

In order to guarantee proper distribution of link forces between the adjacent panels, a plurality of bridging sheets 22 extends along each edge of the internal sheet of the insulating panels 2, a bridging sheet 22 being arranged in each interval between two neighboring grooves 14, 15 of a series of parallel grooves. The bridging sheets 22 may be fastened against the internal sheet 10 of the insulating panels 2 by any appropriate means. However, it has been observed that the combination of the application of a glue between the external face of the bridging sheets 22 and the internal sheet 10 of the insulating panels 2 and of the use of mechanical fastening members, such as staples, permitting pressing of the bridging sheets 22 against the insulating panels 2, was particularly advantageous.

The secondary sealing membrane 4 comprises a plurality of corrugated metal sheets 24, each having a substantially rectangular form. The corrugated metal sheets 24 are arranged in an offset manner relative to the insulating panels 2 of the secondary thermally insulating barrier 1 such that each of said corrugated metal sheets 24 extends jointly over four adjacent insulating panels 2. Each corrugated metal sheet 24 has a first series of parallel corrugations 25 extending in a first direction and a second series of parallel corrugations 26 extending in a second direction. The directions of the series of corrugations 25, 26 are perpendicular. Each of the series of corrugations 25, 26 is parallel to two opposite edges of the corrugated metal sheet 24. The corrugations 25, 26 project toward the exterior of the tank, i.e. in the direction of the carrying structure 3. The corrugated metal sheet 24 comprises, between the corrugations 25, 26, a plurality of planar surfaces. At each intersection between two corrugations 25, 26, the metal sheet comprises a node zone having a summit projecting toward the exterior of the tank. The corrugations 25, 26 of the corrugated metal sheets 24 are housed in the grooves 14, 15 made in the internal sheet 10 of the insulating panels 2. The adjacent corrugated metal sheets 24 are welded together, overlapping. The corrugated metal sheets 24 are anchored on the metal plates 17, 18 by means of spot welds.

Said corrugated metal sheets 24 comprise, along their longitudinal edges and at their four corners, cutouts 28 allowing the passage of the pins 19 intended to fasten the primary thermally insulating barrier 5 to the secondary thermally insulating barrier 1.

The corrugated metal sheets 24 are, for example, made from Invar®—i.e. an alloy of iron and nickel of which the expansion coefficient is typically between $1.2\times10^{-6}$ and $2\times10^{-6}$ $K^{-1}$—or in an iron alloy with a high magnesium content, the expansion coefficient of which is typically of the order of $7\times10^{-6}$ $K^{-1}$. Alternately, the corrugated metal sheets 24 may also be made from stainless steel or aluminum.

The primary thermally insulating barrier 5 comprises a plurality of insulating panels 6 of substantially rectangular parallelepipedal form. The insulating panels 6 are in this case offset relative to the insulating panels 2 of the secondary thermally insulating barrier 1 such that each insulating panel 6 extends over four insulating panels 2 of the secondary thermally insulating barrier 1. In a standard zone, the insulating panels 6 of the primary thermally insulating barrier 5 and the insulating panels 2 of the secondary thermally insulating barrier 1 are oriented such that the longitudinal directions of the insulating panels 2, 6 are parallel to one another.

The insulating panels 6 comprise a structure similar to that of the insulating panels 2 of the secondary thermally insulating barrier 1, i.e. a sandwich structure formed from a layer of insulating polymer foam sandwiched between two rigid sheets, for example made from plywood. The internal sheet 30 of an insulating panel 6 of the primary thermally insulating barrier 5 is equipped with metal plates 32, 33 for anchoring the corrugated metal sheets of the primary sealing membrane 7. The metal plates 32, 33 extend in two perpendicular directions that are each parallel to two opposite edges of the insulating panels 6. The metal plates 32, 33 are fastened in recesses made in the internal sheet 30 of the insulating panel 5 and fastened thereto by screws, rivets or staples, for example.

Furthermore, the internal sheet 30 of the insulating panel 6 is provided with a plurality of relaxation slits 34 that allow the primary sealing membrane 7 to deform without imposing excess mechanical constraints on the insulating panels 6. Such relaxation slits are, in particular, described in document FR 3001945.

The insulating panels 6 of the primary thermally insulating barrier are fastened to the insulating panels 2 of the secondary thermally insulating barrier by means of threaded pins 19. To achieve this, each insulating panel 6 comprises a plurality of cutouts 35 along its edges and at its corners, inside which extends a threaded pin 19. The external sheet of the insulating panels 2 projects inside the cutouts 35 so as to form a bearing surface for a retention member that comprises a threaded bore slipped on each threaded pin 19. The retention member comprises tabs housed inside the cutouts 35 and bearing against the portion of the external sheet projecting inside the cutout 35 so as to sandwich the external sheet between a tab of the retention member and an insulating panel 2 of the secondary thermally insulating barrier 1 and thereby to fasten each insulating panel 6 to the insulating panels 2 that it straddles.

The primary thermally insulating barrier 5 comprises a plurality of closure sheets 38 that make it possible to supplement the bearing surface of the primary sealing membrane 7 at the cutouts 35.

The primary sealing membrane 7 is obtained by assembling a plurality of corrugated metal sheets 39. Each corrugated metal sheet 39 comprises a first series of "high" parallel corrugations 40 extending in a first direction and a second series of "low" parallel corrugations 41 extending in a second direction perpendicular to the first series. The corrugations 40, 41 project toward the inside of the tank. The corrugated metal sheets 39 are, for example, made from stainless steel or aluminum. In a non-illustrated embodiment, the first and the second series of corrugations have identical heights.

Figure 3:
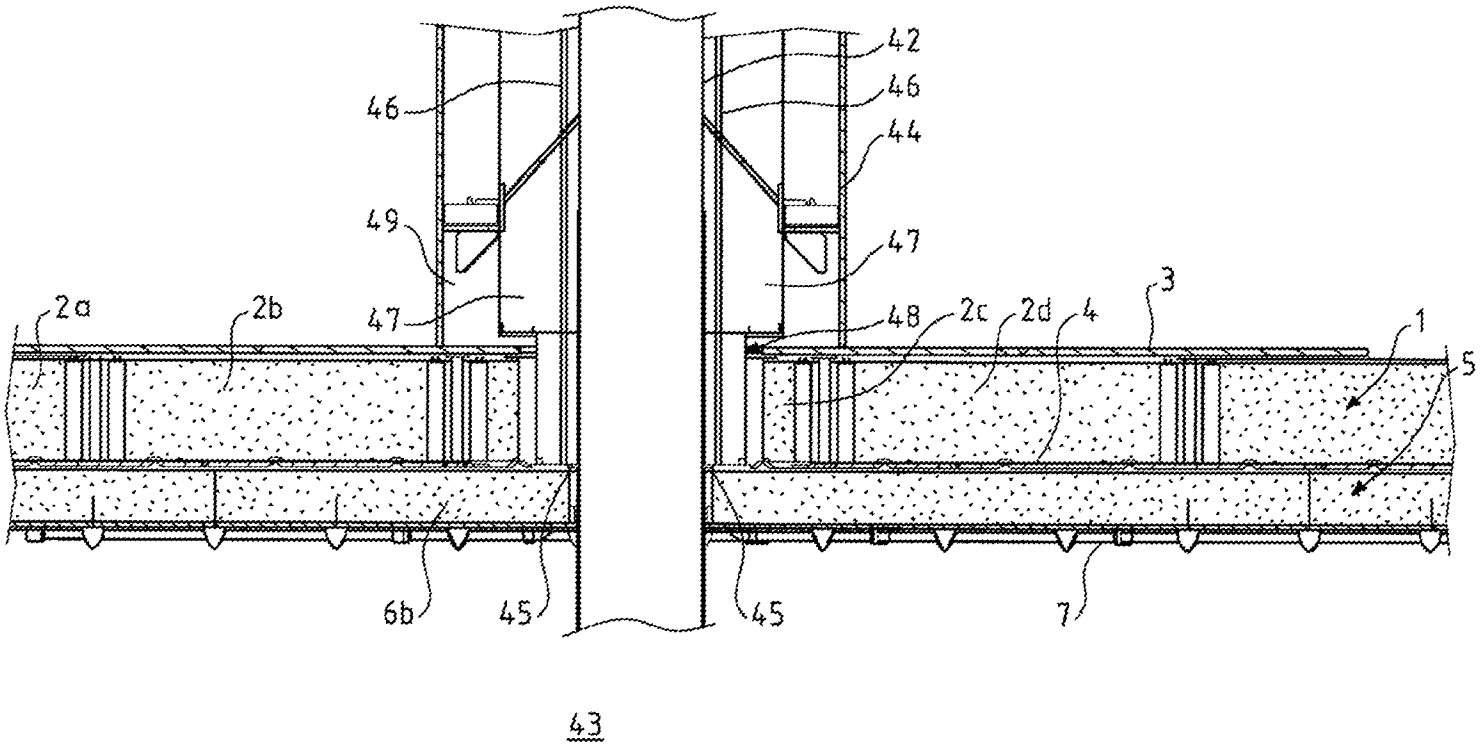
FIG. 3 is a sectional view of a top wall of the tank in a specific zone through which passes a sealed fluid-collection conduit, the section being on the axis III-III in FIG. 7.

FIG. 3 shows a sectional view of the top wall of the tank, in a specific zone, through which passes a sealed conduit 42 for defining a passage between the interior space 43 of the tank and the exterior of the tank. This sealed conduit 42 emerges in a top portion of the interior space 43 of the tank and is designed to evacuate the vapors produced by natural evaporation of the liquefied natural gas stored inside the tank so as to avoid excess pressures.

The carrying structure 3 comprises a circular opening 48 around which is welded a barrel 44 that extends outside of the carrying structure 3. The sealed conduit 42 is anchored inside the barrel 44. The sealed conduit 42 traverses the top wall in the center of the circular opening 48 and also the thermally insulating barriers 1, 5 and the sealing membranes 4, 7 in order to emerge inside the tank. This sealed conduit 42 is, in particular, connected to a non-shown vapor collector arranged outside the tank, which extracts this vapor and conveys it, for example, to a degassing mast, to a steam turbine for powering the ship or to a liquefaction device for subsequent reintroduction of the fluid into the tank.

The primary sealing membrane 7 is connected in a sealed manner to the sealed conduit 42. Similarly, the secondary sealing membrane 4 is connected in a sealed manner to the sealed conduit except at the passages 45 that allow the fluid present in the primary thermally insulating barrier 5, i.e. between the primary 7 and secondary 4 sealing membranes, to circulate toward secondary conduits 46.

Furthermore, the barrel 44 is connected in a sealed manner to the carrying structure 1 and to the sealed conduit 42 in a non-shown top zone. An insulation layer 47 is uniformly distributed over the exterior bearing surface of the sealed conduit 42. A space between the insulation layer 47 and the circular opening 48 allows the circulation of fluid between the secondary insulating barrier 1 and an intermediate space 49 present between the barrel 44 and the insulation layer 47.

The two secondary conduits 46 extend parallel to the sealed conduit 42 in the insulation layer 47 as far as to the passage 45. One of the secondary conduits 46 makes it possible to form a passage between the primary thermally insulating barrier 5 and a non-shown evacuation member, such as a pump, which makes it possible to control the fluids present in the primary thermally insulating barrier 5, while the other secondary conduit 46 makes it possible to form a passage between the primary thermally insulating barrier 5 and a non-shown pressure-measurement member. These two secondary conduits 46 make it possible, in particular, to sweep nitrogen within the primary thermally insulating barrier 5.

Two further non-shown conduits are welded to the barrel 44 and emerge inside the barrel 44 in the intermediate space 49 to likewise allow management of the fluids and the measurement of pressure within the secondary thermally insulating barrier 1.

Figure 8:
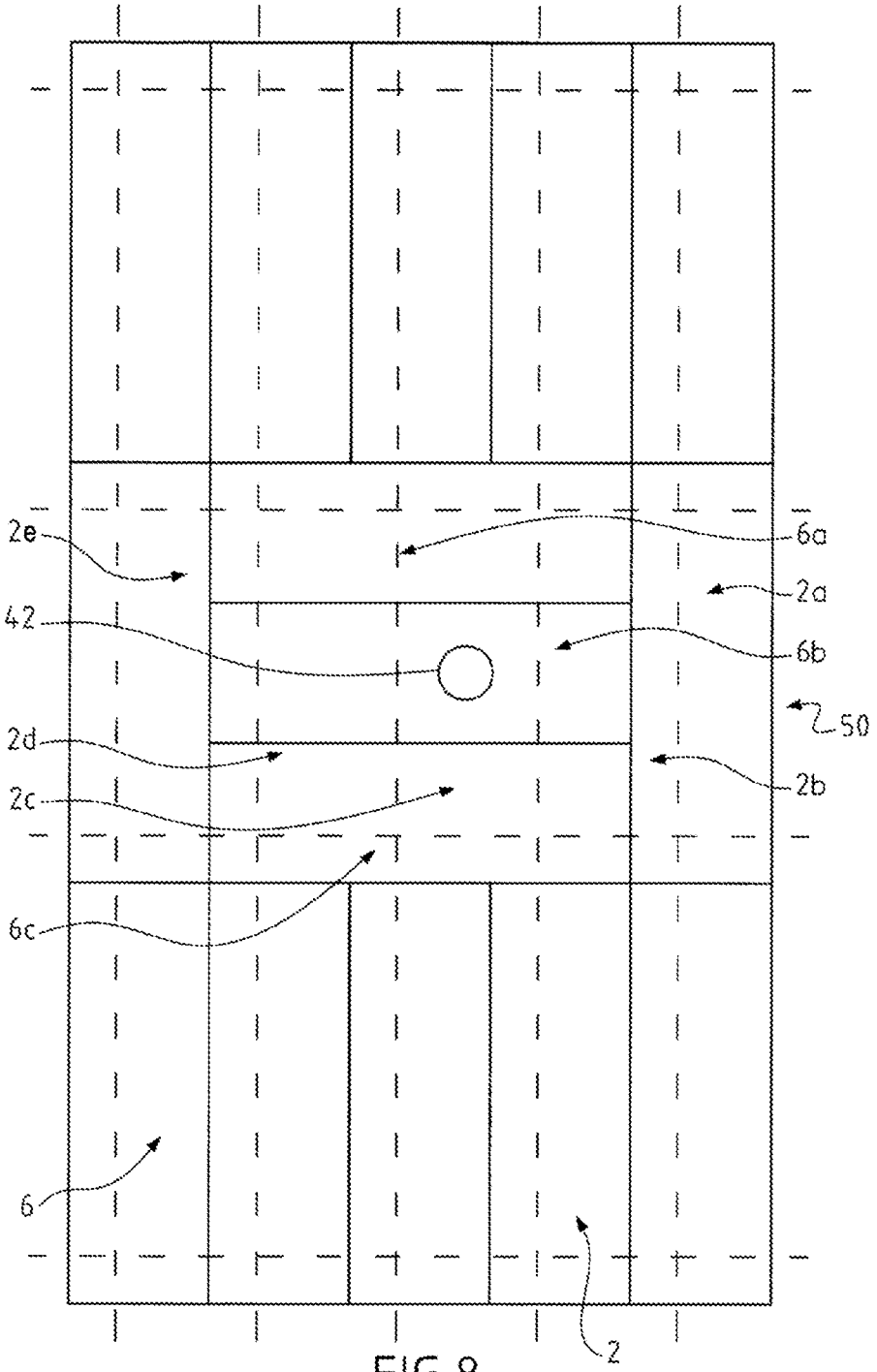
FIG. 8 is a schematic representation of the primary and secondary thermally insulating barriers at the specific zone, the contours of the primary insulating panels being illustrated in solid lines and the contours of the secondary insulating panels being illustrated in broken lines.

FIG. 8 shows the arrangement of the secondary insulating panels 2, 2*a*, 2*b*, 2*c*, 2*d*, 2*e*—the contours of which are illustrated in broken lines—and of the primary insulating panels 6, 6*a*, 6*b*, 6*c*—the contours of which are illustrated in solid lines - in the specific zone of the top wall through which the sealed conduit 42 passes.

In the specific zone, the secondary thermally insulating barrier comprises a row 50 of noteworthy secondary insulating panels 2*a*, 2*b*, 2*c*, 2*d*, 2*e*, one 2*c* of which is traversed by the sealed conduit 42. The sealed conduit 42 traverses a circular opening made in the center of said secondary insulating panel 2*c*. The sealed conduit 42 having a diameter smaller than the transverse dimension of the panel 2*c*, the periphery of the opening is continuous and the edges of said secondary insulating panel 2*c* are not cut out in order to allow the passage of the sealed conduit 42.

The singular row 50 extends perpendicularly to the longitudinal direction of the secondary insulating panels 2, 2*a*, 2*b*, 2*c*, 2*d*, 2*e*. In other words, this singular row 50 is formed from secondary insulating panels 2*a*, 2*b*, 2*c*, 2*d*, 2*e* that are juxtaposed one after another in a direction transverse to the longitudinal direction of the secondary insulating panels 2, 2*a*, 2*b*, 2*c*, 2*d*, 2*e*. This singular row 50 extends substantially over one entire dimension of the top wall, i.e. between two corner zones delimiting said top wall. The secondary insulating panels 2*a*, 2*b*, 2*c*, 2*d*, 2*e* of the singular row 50 have an orientation identical to that of the insulating panels 2 arranged in the standard zone of the tank wall, around the singular row 50. The longitudinal directions of the secondary insulating panels 2, 2*a*, 2*b*, 2*c*, 2*d*, 2*e* are thus parallel to one another over the entire surface of the top wall.

The secondary insulating panels 2*a*, 2*b*, 2*c*, 2*d*, 2*e* of the singular row 50 have a structure substantially identical to that of the secondary insulating panels 2 of the standard zone. The secondary insulating panels 2 of the standard zone and those of the specific zone further have an identical transverse dimension. Each of the secondary insulating panels 2*a*, 2*b*, 2*c*, 2*d* of the singular row 50 is in line with one of the lines of secondary insulating panels 2 juxtaposed in the standard zone one after another in the longitudinal direction of said panels 2.

However, the secondary insulating panels 2*a*, 2*b*, 2*c*, 2*d*, 2*e* of the singular row 50 have a longitudinal dimension shorter than that of the secondary insulating panels 2 of the standard zone. The dimensions of the secondary insulating panels 2 of the standard zone correspond approximately to those of a corrugated metal sheet of the secondary sealing membrane. Thus, as indicated previously, in the standard zone, the secondary insulating panels 2 have on their internal face nine grooves extending in the transverse direction of the panel. The longitudinal dimension of said insulating panels 2 thus corresponds approximately to nine inter-corrugation intervals.

In the embodiment shown, the insulating panels 2*a*, 2*b*, 2*c*, 2*d* of the singular row 50 comprise only seven grooves extending in the transverse direction of the panel, which corresponds to a longitudinal dimension representing approximately seven inter-corrugation intervals.

This singular row 50, of which the panels 2*a*, 2*b*, 2*c*, 2*d*, 2*e* have a longitudinal dimension shorter than that of the panels 2 of the standard zone, makes it possible to ensure that, given the arrangement of the primary insulating panels 6, 6*a*, 6*b*, 6*c*, which will be described below, each of the primary insulating panels 6, 6*a*, 6*b*, 6*c* extends straddling between a plurality of secondary insulating panels 2, 2*a*, 2*b*, 2*c*, 2*d*, 2*e* and can be anchored satisfactorily to the secondary insulating panels at a distance from their edges.

By way of example, the secondary insulating panels 2 of the standard zone have a length approximately 3 meters, for example 3.06 meters, and a width approximately 1 meter, for example 1.02 meters, while the secondary insulating panels 2*a*, 2*b*, 2*c*, 2*d*, 2*e* of the singular row 50 have a length of 2.38 meters for a width of approximately 1 meter, for example 1.02 meters.

However, it will be noted that, according to a further non-illustrated embodiment, the secondary insulating panels 2*a*, 2*b*, 2*c*, 2*d*, 2*e* of the specific zone have a different longitudinal dimension corresponding, for example, to five inter-corrugation intervals.

Furthermore, the primary thermally insulating barrier comprises a series of three noteworthy primary insulating panels 6*a*, 6*b*, 6*c*, one 6*b* of which is traversed by the sealed conduit 42. The three primary insulating panels 6*a*, 6*b*, 6*c* of the singular series have dimensions identical to those of the other secondary insulating panels 6 outside of the specific zone, which makes it possible to standardize the size of the primary insulating panels 6, 6*a*, 6*b*, 6*c* and, as a result, to simplify the manufacture of the primary thermally insulating barrier 1. Advantageously, the primary insulating panels 6 have transverse and longitudinal dimensions identical to those of the secondary insulating panels 2 of the standard zone, for example a length of approximately 3 meters and a width of approximately 1 meter, which makes it possible to preserve an identical offset between the secondary insulating panels 2 and the primary insulating panels 6 over the entire surface of the standard zone. It is noted, however, that the thickness of the primary insulating panels 6 may be identical to or different from that of the secondary insulating panels 2. Advantageously, the thickness of the secondary insulating panels 2 is greater than that of the primary insulating panels 6.

The three primary insulating panels 6*a*, 6*b*, 6*c* are oriented perpendicularly to the other primary insulating panels 6 and to the secondary insulating panels 2, 2*a*, 2*b*, 2*c*, 2*d*, 2*e*. In other words, the longitudinal direction of these three primary insulating panels 6*a*, 6*b*, 6*c* is perpendicular to those of the other panels 2, 2*a*, 2*b*, 2*c*, 2*d*, 2*e*, 6. Thus, by virtue of the change in orientation of these three primary insulating panels 6*a*, 6*b*, 6*c*, the sealed conduit 42 traverses an opening, with a continuous circular periphery, that is made in the central panel 6*b* of the series of three insulating panels 6*a*, 6*b*, 6*c* and centered in the middle of the transverse dimension of said panel 6*b*. Hence, despite the relatively significant dimensions of the sealed conduit 42, the latter passes through an opening made in a secondary insulating panel 2*c* and a circular opening made in a primary insulating panel 6*b*, doing so without a cutout being formed in one edge of said panels 2*c*, 6*b*, with each of the primary insulating panels 6, 6*a*, 6*b*, 6*c* anchored straddling a plurality of secondary insulating panels 2, 2*a*, 2*b*, 2*c*, 2*d*, 2*e*.

The primary insulating panels 6, 6*a*, 6*b*, 6*c* have a longitudinal dimension that is a full multiple of their transverse dimension and the series of noteworthy primary insulating panels 6*a*, 6*b*, 6*c* comprises a corresponding entire number of panels. Hence, an arrangement of this type makes it possible to preserve the alignments of the primary insulating panels 6 in rows parallel to one another in the standard zone, outside of the specific zone.

It is further noted that the arrangement of the secondary and primary thermally insulating barriers, as described above, makes it possible to center the sealed conduit 42 longitudinally and transversely on a secondary insulating panel 2*c* and to center the sealed conduit 42 in the transverse dimension of a primary insulating panel 6*b*, which makes it possible to better distribute the stresses in the secondary and primary thermally insulating barriers.

Figure 4:
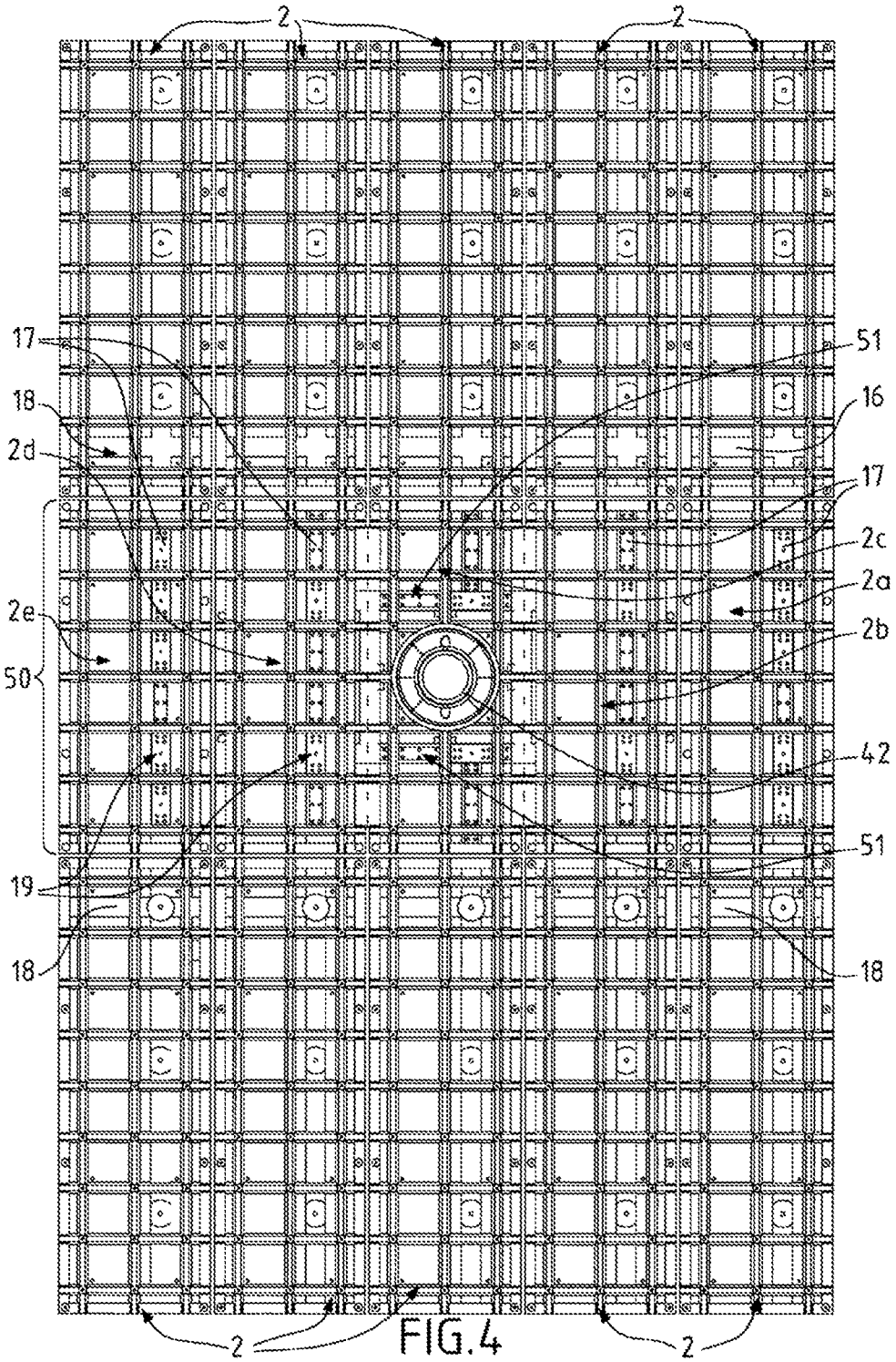
FIG. 4 is a bottom view of the top wall representing the secondary thermally insulating barrier at the specific zone.

FIG. 4 illustrates in detail the secondary insulating panels 2, 2*a*, 2*b*, 2*c*, 2*d*, 2*e* at the specific zone traversed by the sealed conduit 42. With the exception of the insulating panel 2*c* traversed by the sealed conduit 42, the other secondary insulating panels 2*a*, 2*b*, 2*d*, 2*e* of the singular row 50 comprise only metal sheets 17 extending in the longitudinal direction of said panels 2*a*, 2*b*, 2*d*, 2*e*, since the edges of the longitudinal ends of each of the metal sheets of the secondary sealing membrane that cover the singular row 50 project on either side of the longitudinal ends of the panels 2*a*, 2*b*, 2*d*, 2*e* and are welded on the metal plates 18 of the secondary insulating panels 2 bordering the singular row 50.

The secondary insulating panel 2*c* traversed by the sealed conduit 42 has, on either side of the sealed conduit 42, metal plates 51 extending in the transverse direction of said panel 2*c*. These metal plates 51 are intended for anchoring a secondary closure sheet equipped with an opening through which passes the sealed conduit, which will be described in more detail below.

Furthermore, the pins 19 fixed on the internal sheet 10 of the panels are positioned in accordance with the arrangement of the primary insulating panels 6, 6*a*, 6*b*, 6*c* such that each primary insulating panel 6, 6*a*, 6*b*, 6*c* is anchored at its four corners and at its lateral edges on the secondary insulating panels 2, 2*a*, 2*b*, 2*c*, 2*d*, 2*e*.

Figure 5:
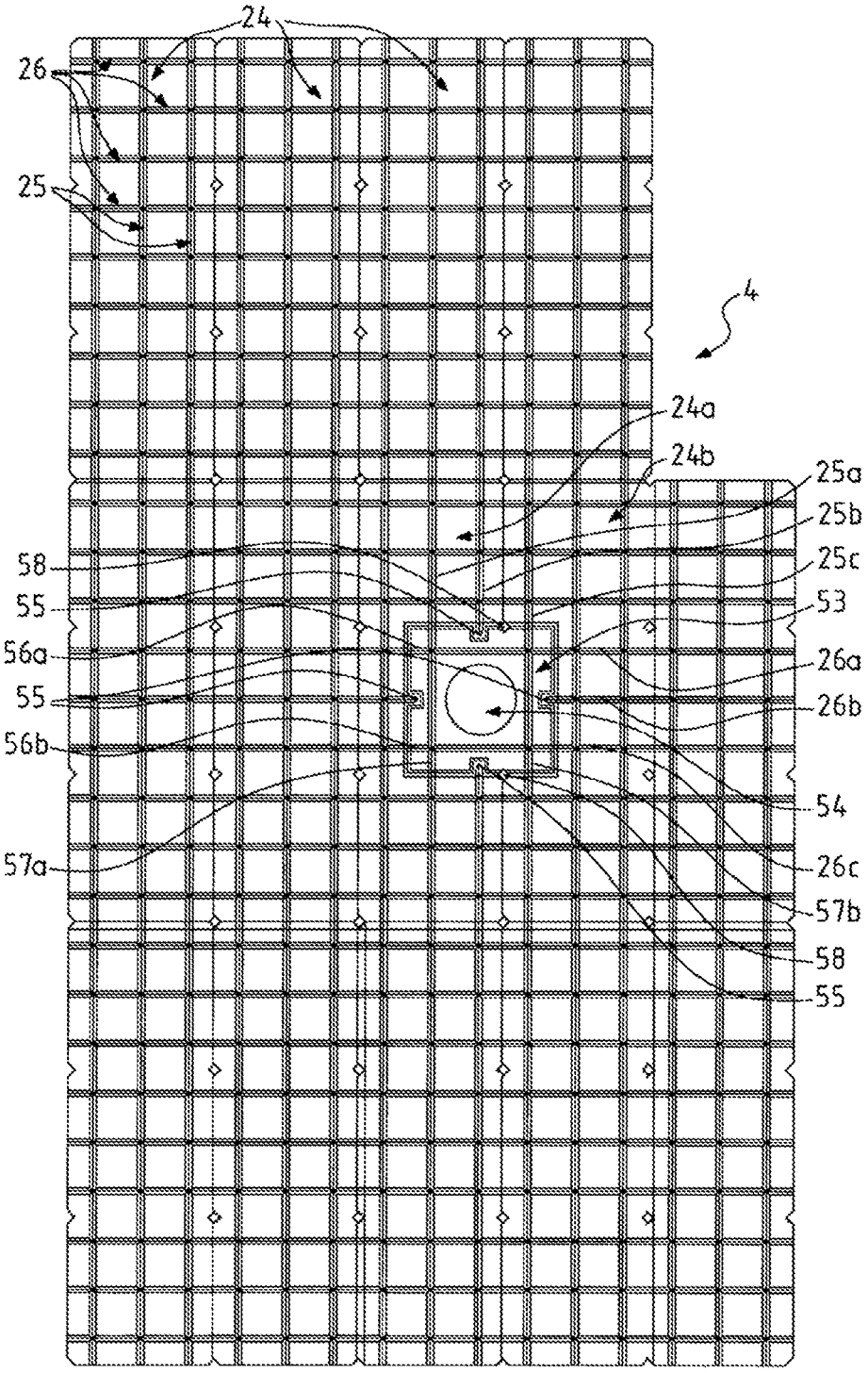
FIG. 5 is a peeled-away bottom view of the secondary sealing membrane at the specific zone.

FIG. 5 illustrates in detail the secondary sealing membrane 4 in the specific zone. The secondary sealing membrane 4 comprises a metal secondary closure sheet 53 of square form. The secondary closure sheet 53 has a central circular opening 54 through which passes the sealed conduit, which is not illustrated in FIG. 5. The secondary closure sheet 53 is welded on the aforesaid metal plates 51, which are fastened to the secondary insulating panel 2*c*. Furthermore, the two corrugated metal sheets 24*a*, 24*b* arranged on either side of the sealed conduit 42 are cut out in order to provide a window having dimensions slightly smaller than those of the secondary closure sheet 53. The two corrugated metal sheets 24*a*, 24*b* are welded with overlapping in a sealed manner on the secondary closure sheet 53.

The secondary closure sheet 53 has dimensions such that each of its sides meets a series of three corrugations 25*a*, 25*b*, 25*c*, 26*a*, 26*b*, 26*c*. The sealed conduit 42 is centered on a position corresponding to the intersection between the directrices of the central corrugations 25*b*, 26*b* of each of these series. The directrices of the central corrugations 25*b*, 26*b* are thus interrupted at the secondary closure plate 53. The central corrugations 25*b*, 26*b* are closed in a sealed manner with end pieces 55. Each end piece 55 comprises a two-part sole plate welded in a sealed manner to the secondary closure sheet 53 and a shell welded in a sealed manner to the central corrugation 25*b*, 26*b* at the interruption thereof.

Furthermore, the secondary closure sheet 53 has two pairs of parallel corrugations 56*a*, 56*b*, 57*a*, 57*b*. Each of the pairs 56*a*, 56*b*, 57*a*, 57*b* has corrugations perpendicular to those of the other pair. Moreover, the two corrugations 56*a* and 56*b* or 57*a* or 57*b* of one and the same pair pass on either side of the circular opening 54 and extend in the extension of the two lateral corrugations 25*a*, 25*c*, 26*a*, 26*c* of one of the series meeting the secondary closure sheet 53. Thus, the continuity of a part of the corrugations 25*a*, 25*c*, 26*a*, 26*c* meeting the secondary closure sheet 53 is ensured, which makes it possible to limit elasticity losses of the secondary sealing membrane 4 at the specific zone.

The corrugations 56*a*, 56*b*, 57*a*, 57*b* of the secondary closure sheet 53 project toward the exterior of the tank, i.e. in the direction of the carrying structure, and are housed inside grooves 14, 15 formed in the internal sheet of the secondary insulating panel 2*c*.

It is further noted that the secondary closure sheet 53 is likewise equipped with cutouts 58 allowing the passage of pins, which are not illustrated in FIG. 5, intended to fasten the primary insulating panels 6*a*, 6*b*, 6*c* of the primary thermally insulating barrier.

Figure 6:
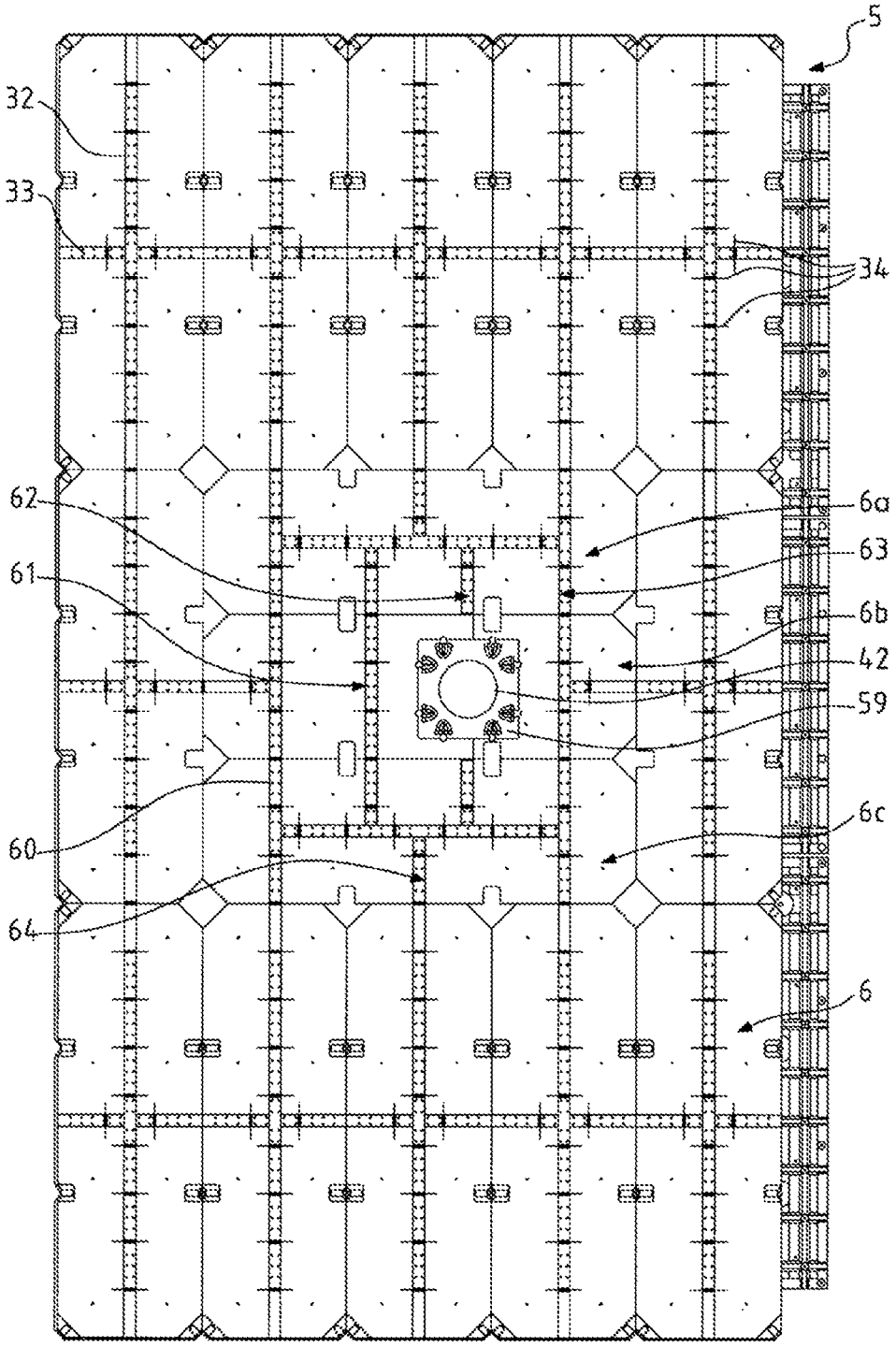
FIG. 6 is a peeled-away bottom view of the top wall at the specific zone; the primary sealing membrane not being shown in order to reveal the primary thermally insulating barrier.

FIG. 6 illustrates in detail the arrangement of the primary thermally insulating barrier 5 in the specific zone of the top wall. As described previously, one 6*b* of the primary insulating panels of the series of three noteworthy panels 6*a*, 6*b*, 6*c*, the orientation of which is perpendicular to that of the other primary insulating panels 6, is traversed by the sealed conduit 42. A primary closure sheet 59 of the primary sealing membrane 7 is fastened on said primary insulating panel 6*b*. The primary closure plate 59 is provided with an opening for passage of the sealed conduit 42. The sealed conduit 42 is welded in a sealed manner to the primary closure sheet 59.

Only the three primary insulating panels 6*a*, 6*b*, 6*c* are affected by the passage of the sealed conduit 42 through the specific zone, the other primary insulating panels 6 having an identical structure.

The primary insulating panels 6*a*, 6*b*, 6*c* have, in effect, arrangements of metal plates 60, 61, 62, 63, 64 that are arranged such that they are adapted to anchoring the edges of the metal sheets of the primary sealing membrane 7 that are arranged in the specific zone and that have particular dimensions.

Figure 7:
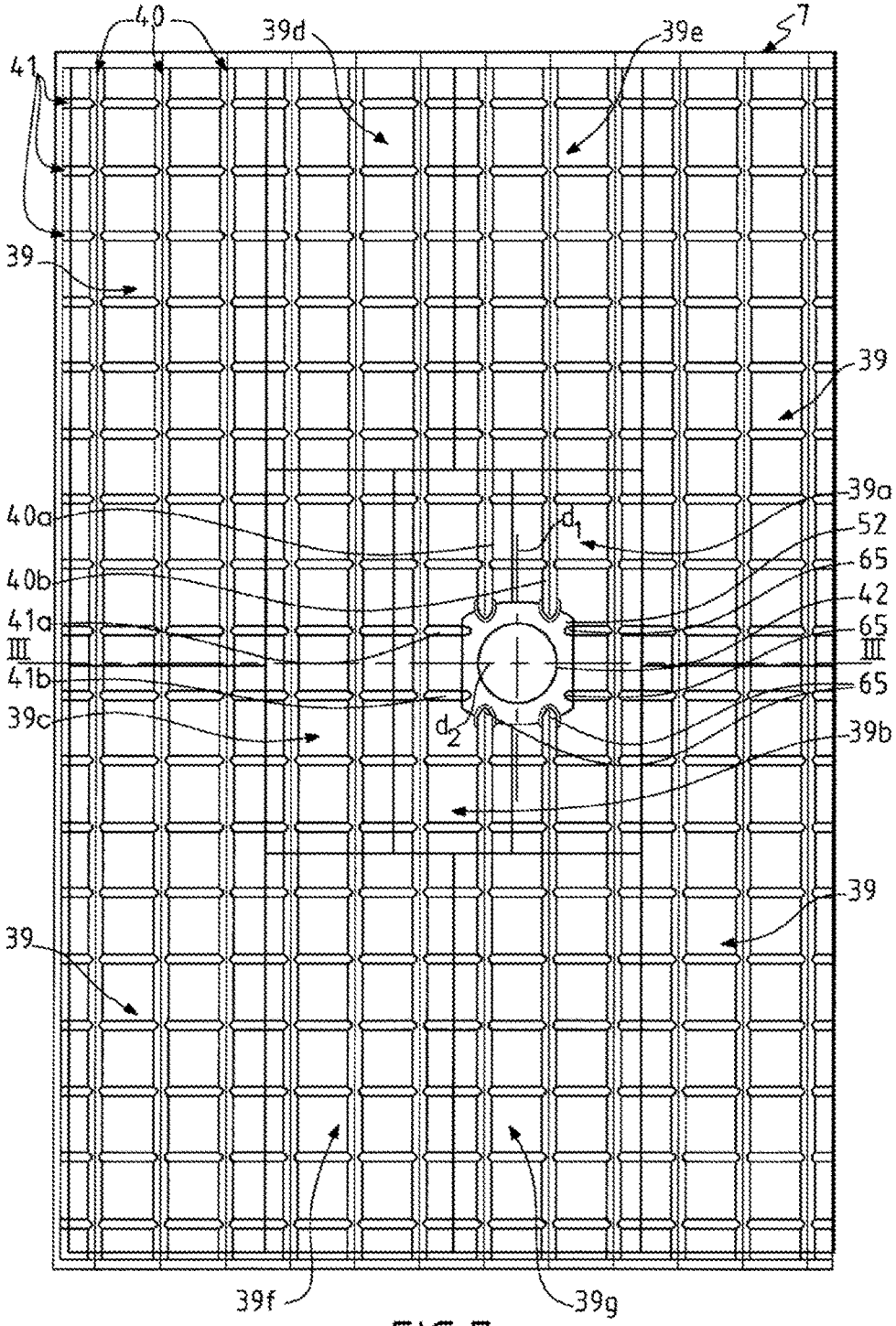
FIG. 7 is a bottom view of the top wall representing the primary sealing membrane at the specific zone.

The arrangement of the primary sealing membrane 7 in the specific zone of the top wall is shown in FIG. 7. Only seven corrugated metal sheets 39*a*, 39*b*, 39*c*, 39*d*, 39*e*, 39*f*, 39*g* have dimensions different from those of the standard corrugated metal sheets 39 covering the standard zone of the tank wall. This particular arrangement aims to avoid the cutting-out of a window in the primary sealing membrane 7, to allow the passage of the sealed conduit 42, being made at a corner zone of the corrugated metal sheets 39, which would have the effect of influencing their mechanical behavior.

The two corrugated metal sheets 39*a*, 39*b* arranged on either side of the sealed conduit 42 have smaller dimensions than those of the standard corrugated metal sheets 39. Thus, these two corrugated metal sheets 39*a*, 39*b* comprise only two large corrugations for six small corrugations. The two corrugated metal sheets 39*a*, 39*b* each have a cutout made along one of their longitudinal edges and centered on the longitudinal dimension of said corrugated metal sheet 39*a*, 39*b*. The cutouts together provide a window having dimensions slightly smaller than those of the primary closure sheet 52. The two corrugated metal sheets 39*a*, 39*b* are welded overlapping on the entire periphery of the primary closure sheet 52.

The primary closure sheet 52 comprises dimensions such that each of its sides meets a series of two corrugations 40*a*, 40*b*, 41*a*, 41*b*. The sealed conduit 42 is centered on a position corresponding to the intersection between two perpendicular straight lines $d_1$, $d_2$, one ($d_1$) of which is parallel to two corrugations 40*a*, 40*b* of one of the series and arranged equidistantly between these two corrugations 40*a*, 40*b* and the other ($d_2$) of which is parallel to the two corrugations 41*a*, 41*b* of the other of the series and arranged equidistantly therebetween.

The corrugations 40*a*, 40*b*, 41*a*, 41*b* meeting the primary closure sheet 52 are closed in a sealed manner with end pieces 65. The end pieces 65 each comprise a two-part sole plate welded in a sealed manner to the primary closure sheet 52 and a shell welded in a sealed manner to the corrugation at the interruption thereof.

Furthermore, in order to compensate for the particular dimensions of the two corrugated metal sheets 39*a*, 39*b* bordering the sealed conduit 42 so as to fall onto the mesh of the corrugated metal sheets 39 in the standard zone, the primary sealing membrane comprises five other compensating corrugated metal sheets 39*c*, 39*d*, 39*e*, 39*f*, 39*g*, the dimensions of which are adjusted such that the arrangement of the assembly of the two metal sheets 39*a*, 39*b* bordering the sealed conduit 45 and the five corrugated metal sheets 39*c*, 39*d*, 39*e*, 39*f*, 39*g* are equivalent to the arrangement of four corrugated metal sheets of standard dimensions.

Thus, the compensating metal sheet 39*c* comprises two high corrugations 40 for six low corrugations 39 while the four other compensating metal sheets 39*d*, 39*e*, 39*f*, 39*g* each have three high corrugations 40 for six low corrugations 39.

Figure 10:
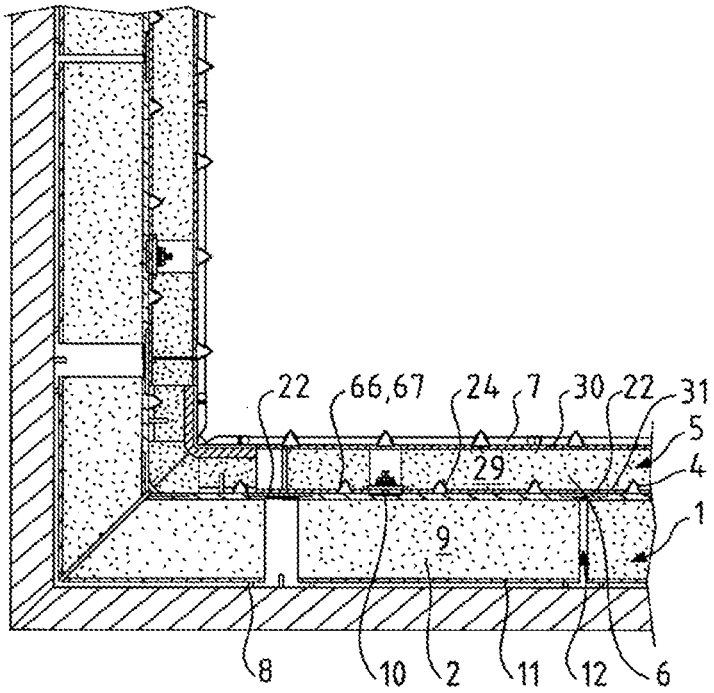
FIG. 10 is a sectional view of a sealed and thermally insulating tank for storing a fluid at a corner zone between two walls, according to a further embodiment.

In a further embodiment, shown in FIG. 10, the corrugated metal sheets 24 of the secondary sealing membrane 4 comprise corrugations 66 projecting toward the interior of the tank, unlike the corrugations of the preceding embodiment. The corrugated metal sheets 24 of the secondary sealing membrane 4 likewise comprise two series of perpendicular corrugations 66. As in the preceding embodiments, the corrugated metal sheets 24 are fastened to the internal sheet 10 of the insulating panels 2 of the secondary thermally insulating barrier 1 by means of non-shown metal plates extending in two perpendicular directions, which are fastened to the internal sheet 10 of the insulating panels 2.

However, in this embodiment, the external sheet 30 of the insulating panels 6 of the primary thermally insulating barrier 5 have two series of grooves 67 perpendicular to one another so as to form a network of grooves. The grooves 67 are thus intended for receiving the corrugations 66 projecting toward the interior of the tank, formed on the corrugated metal sheets 24 of the secondary sealing membrane 4.

In an embodiment of this type, the secondary sealing membrane comprises a general structure identical to that shown in FIG. 5, the only difference lying in the orientation of the corrugations 66 toward the interior of the tank.

Figure 11:
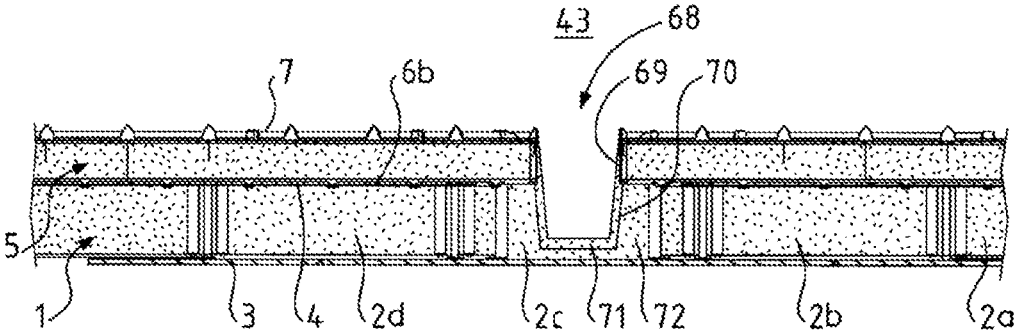
FIG. 11 is a sectional view, similar to that of FIG. 3, that illustrates a bottom wall of the tank in a specific zone through which passes a draining structure.

Furthermore, it should be noted that although the invention has been described above in connection with a through-element that is a sealed conduit 42 passing through a specific zone of the wall to define a passage between the interior space of the tank and the exterior of the tank, it is not thereby limited to an embodiment of this type. Indeed, a sealed and thermally insulating tank wall structure such as that described above may also be produced at any other type of through-element and, in particular, at a draining structure 68, as illustrated in FIG. 11, passing through the bottom wall and intended to receive an aspiration member, for example a non-illustrated pump.

The draining structure 68 comprises a primary conical or cylindrical bowl 69, the axis of which is perpendicular to the carrying wall 3. The primary cylindrical bowl 69 is connected continuously to the primary sealing membrane 7 that it supplements, thus, in a sealed manner. The draining structure further comprises a secondary conical or cylindrical bowl 70, concentric with the primary bowl 69, which is connected continuously to the secondary sealing membrane 4 that it supplements, thus, in a sealed manner. Furthermore, the draining structure 68 also comprises insulating materials 71 that are housed between the primary and secondary cylindrical bowls 69, 70 and also insulating materials 72 interposed between the secondary bowl 70 and the carrying structure 3 in order to ensure the continuity of the thermal insulation of the primary and secondary thermally insulating barriers 1, 5 at the draining structure 68.

The tank described above may be used in different types of installation, in particular in an onshore installation or in a floating structure such as a methane carrier or the like.

Figure 9:
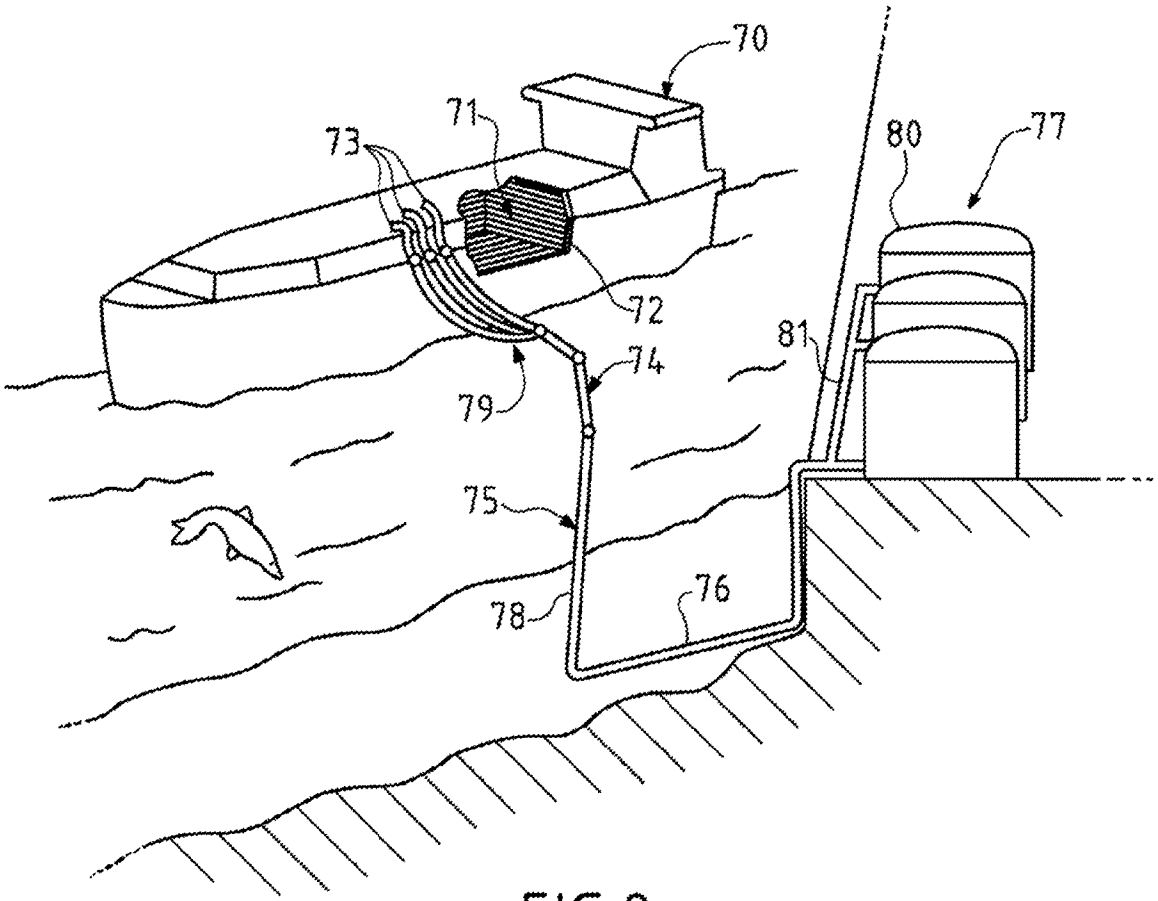
FIG. 9 is a schematic peeled-away representation of a tank of a methane carrier comprising a sealed and thermally insulating tank for storing a fluid and of a terminal for loading/unloading this tank.

With reference to FIG. 9, a peeled-away view of a methane carrier 70 shows a sealed and insulated tank 71 of this type of general prismatic form, mounted in the double hull 72 of the ship.

In a manner known per se, loading/unloading pipes 73 arranged on the top deck of the ship may be connected, by means of appropriate connectors, to an offshore or port terminal in order to transfer a cargo of LNG from or toward the tank 71.

FIG. 9 also shows an example of an offshore terminal comprising a loading and unloading station 75, a subsea conduit 76 and an onshore installation 77. The loading and unloading station 75 is a fixed offshore installation comprising a movable arm 74 and a tower 78 that supports the movable arm 74. The movable arm 74 carries a bundle of insulated flexible hoses 79 that can be connected to the loading/unloading pipes 73. The orientable movable arm 74 is adapted to all methane-carrier sizes. A non-shown link conduit extends inside the tower 78. The loading and unloading station 75 makes it possible to load and unload the methane carrier 70 from or toward the onshore installation 77. The latter comprises liquefied-gas storage tanks 80 and link conduits 81 connected by the subsea conduit 76 to the loading or unloading station 75. The subsea conduit 76 allows the transfer of the liquefied gas between the loading or unloading station 75 and the onshore installation 77 over a large distance, for example 5 km, which makes it possible to keep the methane carrier 70 at a significant distance from the coast during the loading and unloading operations.

In order to create the pressure necessary for the transfer of the liquefied gas, pumps onboard the ship 70 and/or pumps equipping the onshore installation 77 and/or pumps equipping the loading and unloading station 75 are implemented.

Although the invention has been described in connection with a plurality of particular embodiments, it is obvious that it is in no way limited thereto and comprises all technical equivalents of the means described and also combinations thereof if such combinations fall within the scope of the invention.

The use of the verb "to comprise" or "to include" and conjugated forms thereof does not exclude the presence of elements or steps other than those mentioned in a claim. The use of the indefinite article "a" or "an" for an element or a step does not exclude, unless there is mentioned to the contrary, the presence of a plurality of such elements or steps.

In the claims, any reference sign between parentheses should not be interrupted as a limitation of the claim.

The invention claimed is:

1. A sealed and thermally insulating tank intended for the storage of a fluid, said tank comprising a tank wall fixed to a carrying structure (3), the wall comprising successively, in the direction of the thickness, from the exterior to the interior of the tank, a secondary thermally insulating barrier (1) retained against the carrying structure (3), a secondary sealing membrane (4) carried by the secondary thermally insulating barrier (1), a primary thermally insulating barrier (5) resting against the secondary sealing membrane (4), and a primary sealing membrane (7) carried by the primary thermally insulating barrier (5) and designed to be in contact with the fluid contained in the tank;

the secondary thermally insulating barrier (1) comprising juxtaposed secondary insulating panels (2, 2*a*, 2*b*, 2*c*, 2*d*, 2*e*), retained against the carrying structure (3) and having a rectangular parallelepipedal form having a longitudinal direction, each secondary insulating panel (2, 2*a*, 2*b*, 2*c*, 2*d*, 2*e*) having an internal face, opposite the carrying wall, equipped with at least one anchoring member (19);

the primary thermally insulating barrier (5) comprising juxtaposed primary insulating panels (6, 6*a*, 6*b*, 6*c*), having a rectangular parallelepipedal form having a longitudinal direction, each primary insulating panel (6, 6*a*, 6*b*, 6*c*) being arranged straddling at least four secondary insulating panels (2, 2*a*, 2*b*, 2*c*, 2*d*, 2*e*) and anchored to said anchoring member (19) of each of the secondary insulating panels that said primary insulating panel straddles;

the sealed tank being equipped with a through-element (42, 68) passing through a specific zone of the wall;

the primary thermally insulating barrier (5) comprising, in the specific zone of the tank wall, a primary series of primary insulating panels (6*a*, 6*b*, 6*c*) having mutually parallel longitudinal directions;

the secondary thermally insulating barrier (1) comprising, in the specific zone of the wall, a secondary series of secondary insulating panels (2*a*, 2*b*, 2*c*, 2*d*, 2*e*) having mutually parallel longitudinal directions; the primary series and the secondary series being arranged one relative to the other such that the longitudinal directions of the primary insulating panels (6*a*, 6*b*, 6*c*) of the primary series are perpendicular to the longitudinal directions of the secondary insulating panels (2*a*, 2*b*, 2*c*, 2*d*, 2*e*) of the secondary series;

the through-element (42, 68) extending in the direction of the thickness of the specific zone of the wall and passing successively through an opening made in one (2*c*) of the secondary insulating panels of the secondary series, through an opening (54) made in the secondary sealing membrane (4), through an opening made in one (6*b*) of the primary insulating panels of the first series, and through an opening made in the primary sealing membrane (7).

2. The tank as claimed in claim 1, wherein the secondary insulating panels (2), arranged in a remaining zone located around the specific zone of the wall, are arranged in parallel rows and have longitudinal directions oriented parallel to one another, and the primary insulating panels (6), arranged in said remaining zone, are arranged in parallel rows and have longitudinal directions oriented parallel to one another.

3. The tank as claimed in claim 2, wherein the longitudinal directions of the secondary insulating panels (2) of the remaining zone are parallel to the longitudinal directions of the primary insulating panels (6) of the remaining zone, and wherein the longitudinal directions of the insulating panels (6*a*, 6*b*, 6*c*) of one of the primary and secondary series are oriented perpendicularly to the longitudinal directions of the primary and secondary insulating panels (2, 6) of the remaining zone, and the longitudinal directions of the insulating panels (2*a*, 2*b*, 2*c*, 2*d*, 2*e*) of the other of the primary and secondary series are oriented parallel to the longitudinal directions of the primary and secondary insulating panels (2, 6) of the remaining zone.

4. The tank as claimed in claim 3, wherein the series of which the insulating panels (6*a*, 6*b*, 6*c*) have longitudinal directions oriented perpendicularly to the longitudinal directions of the primary and secondary insulating panels (2, 6) of the remaining zone is the primary series.

5. The tank as claimed in claim 4, wherein the primary insulating panels (6) of the remaining zone have dimensions identical to those of the primary insulating panels (6*a*, 6*b*, 6*c*) of the primary series.

6. The tank as claimed in claim 5, wherein the primary insulating panels (6, 6*a*, 6*b*, 6*c*) each have a longitudinal dimension equal to n times their transverse dimension, n being an integer greater than 1, and wherein the primary series comprises n primary insulating panels (6*a*, 6*b*, 6c).

7. The tank as claimed in claim 2, wherein the secondary insulating panels (2) of the remaining zone have longitudinal and transverse dimensions identical to those of the primary insulating panels (6) of the remaining zone.

8. The tank as claimed in claim 2, wherein the secondary series of secondary insulating panels (2*a*, 2*b*, 2*c*, 2*d*, 2*e*) comprises a row of secondary insulating panels extending from one edge to the other of the tank wall in a transverse direction perpendicular to the longitudinal direction of said secondary insulating panels, and wherein the secondary insulating panels (2*a*, 2*b*, 2*c*, 2*d*, 2*e*) of the secondary series have a longitudinal dimension smaller than the longitudinal dimension of the secondary insulating panels (2) in the remaining zone.

9. The tank as claimed in claim 1, wherein the opening through which passes the through-element (42, 68) that is made in the secondary insulating panel (2*c*) of the secondary series is arranged in the center of said secondary insulating panel (2*c*).

10. The tank as claimed in claim 1, wherein the opening through which passes the through-element (42, 68) that is made in the primary insulating panel (6*b*) of the primary series is centered in the middle of the transverse dimension of said primary insulating panel (6*b*).

11. The tank as claimed in claim 1, wherein each secondary insulating panel (2, 2*a*, 2*b*, 2*c*, 2*d*, 2*e*) is associated with the adjacent secondary insulating panels by means of a plurality of bridging elements (22), each bridging element (22) being arranged straddling between at least said secondary insulating panel and one said adjacent secondary insulating panel and being fixed, on the one hand, to an edge of the internal face of one of the secondary insulating panels and, on the other, to a facing edge of the internal face of the other secondary insulating panel so as to oppose a mutual distancing of said adjacent secondary insulating panels.

12. The tank as claimed in claim 1, in which the internal face of each secondary insulating panel (2, 2*a*, 2*b*, 2*c*, 2*d*, 2*e*) is equipped with metal plates (17, 18, 51), the secondary sealing membrane (4) comprising, in the specific zone of the wall, a secondary closure sheet (53) equipped with the opening (54) through which passes the through-element (42, 48); said secondary closure sheet (53) being welded on the metal plates (51) of the secondary insulating panel (2*c*) equipped with the opening.

13. The tank as claimed in claim 12, wherein the secondary sealing membrane (4) comprises a plurality of corrugated secondary metal sheets (24, 24*a*, 24*b*) welded to one another in a sealed manner and each comprising at least two perpendicular corrugations (25, 26), said secondary metal sheets (24, 24*a*, 24*b*) being welded on the metal plates (17, 18, 51) of the secondary insulating panels (2, 2*a*, 2*b*, 2*c*, 2*d*, 2*e*), the corrugated secondary metal sheets (24*a*, 24*b*) adjacent the secondary closure sheet (53) being welded on the latter.

14. The tank as claimed in claim 13, wherein the through-element (42, 68) is centered on a position corresponding to the intersection between the mutually perpendicular directrices of two corrugations (25*b*, 26*b*) of the secondary metal sheets (24*a*, 24*b*).

15. The tank as claimed in claim 12, wherein the secondary closure sheet (53) comprises two pairs of parallel corrugations (56*a*, 56*b*, 57*a*, 57*b*), the two corrugations (56*a*, 56*b*; 57*a*, 57*b*) of one and the same pair passing on either side of the opening (54) and each extending in the extension of a corrugation (25*a*, 25*c*, 26*a*, 26*c*) of one of the secondary corrugated metal sheets (24*a*, 24*b*).

16. The tank as claimed in claim 13, wherein the corrugations (25, 26) of the secondary metal sheets (24, 24*a*, 24*b*) project toward the exterior of the tank in the direction of the carrying structure, the internal face of the secondary insulating panels (2, 2*a*, 2*b*, 2*c*, 2*d*, 2*e*) having perpendicular grooves (14, 15) receiving the corrugations (25, 26) of the secondary metal sheets (24, 24*a*, 24*b*).

17. The tank as claimed in claim 13, wherein the corrugations (66) of the secondary metal sheets (24) project toward the interior of the tank, the primary insulating panels (6) each having an external face (31) having perpendicular grooves (67) receiving the corrugations (66) of the corrugated metal sheets (24) of the secondary sealing membrane (4).

18. The tank as claimed in claim 1, wherein the primary sealing membrane (7) comprises, in the specific zone of the wall, a primary closure sheet (52) equipped with the opening of the primary sealing membrane through which passes the through-element; said primary sealing sheet (52) being welded in a sealed manner to the through-element (52) and being fixed on the primary insulating panel (6*b*) equipped with the opening.

19. The sealed tank as claimed in claim 18, wherein each primary insulating panel (6, 6*a*, 6*b*, 6*c*) of the primary thermally insulating barrier has an internal face, opposite the carrying wall; said internal face being equipped with metal plates (32, 33, 60, 61, 62, 63), the primary sealing membrane (7) comprising a plurality of corrugated primary metal sheets (39, 39*a*, 39*b*, 39*c*, 39*d*, 39*e*, 39*f*, 39*g*) welded to one another in a sealed manner and each comprising at least two perpendicular corrugations (40, 41, 40*a*, 40*b*, 41*a*, 41*b*), said primary metal sheets (39, 39*a*, 39*b*, 39*c*, 39*d*, 39*e*, 39*f*, 39*g*) being welded on the metal plates of the primary insulating panels (6, 6*a*, 6*b*, 6*c*), the corrugated primary metal sheets (39*a*, 39*b*) adjacent the primary closure sheet (52) being welded to the latter.

20. The sealed tank as claimed in claim 19, wherein the through-element (42, 68) is centered on a position corresponding to the intersection between a first and a second straight line (d1, d2), the first straight line (d1) being parallel to a first pair of parallel corrugations (40*a*, 40*b*) of the primary sealing membrane (7) and arranged equidistantly between the corrugations (40*a*, 40*b*) of the first pair and the second straight line (d2) being parallel to a second pair of parallel corrugations (41*a*, 41*b*) that are perpendicular to the corrugations (40*a*, 40*b*) of the first pair and arranged equidistantly between the corrugations (41*a*, 41*b*) of the second pair.

21. The sealed tank as claimed in claim 1, wherein the through-element (42) is a sealed conduit passing through a specific zone of the wall in order to define a passage between the interior space of the tank and the exterior of the tank.

22. The sealed tank as claimed in claim 1, wherein the through-element (68) is a draining structure.

23. A ship (70) for transporting a fluid, the ship comprising a double hull (72) and a tank (71) as claimed in claim 1 arranged in the double hull.

24. A method for loading or unloading a ship (70) as claimed in claim 23, wherein a fluid is conveyed through insulated pipes (73, 79, 76, 81) from or toward a floating or onshore storage installation (77) toward or from the ship's tank (71).

25. A system for transferring a fluid, the system comprising a ship (70) as claimed in claim 23, insulated pipes (73, 79, 76, 81) arranged in such a manner as to connect the tank (71) installed in the hull of the ship to a floating or onshore storage installation (77) and a pump for entraining a fluid through the insulated pipes from or toward the floating or onshore storage installation toward or from the ship's tank.

* * * * *